US008545260B2

(12) United States Patent
Zhou et al.

(10) Patent No.: US 8,545,260 B2
(45) Date of Patent: Oct. 1, 2013

(54) BASE AND ELECTRONIC APPARATUS USING THE SAME

(75) Inventors: Cong-Bing Zhou, Shenzhen (CN); Tai-Shan Zhu, Shenzhen (CN)

(73) Assignees: Fu Tai Hua Industry (Shenzhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 64 days.

(21) Appl. No.: 13/331,442

(22) Filed: Dec. 20, 2011

(65) Prior Publication Data

US 2012/0220162 A1 Aug. 30, 2012

(51) Int. Cl.
*H01R 13/72* (2006.01)

(52) U.S. Cl.
USPC ..... 439/501; 191/12.4

(58) Field of Classification Search
USPC ..... 439/501, 502, 528; 191/12.2 R, 191/12.4
See application file for complete search history.

(56) References Cited

U.S. PATENT DOCUMENTS

| | | | | |
|---|---|---|---|---|
| 4,467,979 | A * | 8/1984 | Koehler | 242/396.1 |
| 5,255,767 | A * | 10/1993 | Norwood | 191/12.2 R |
| 6,736,661 | B2 * | 5/2004 | Homer | 439/344 |
| 6,854,575 | B1 * | 2/2005 | Desormeaux et al. | 191/12.4 |
| 8,375,507 | B2 * | 2/2013 | Lee et al. | 15/323 |

* cited by examiner

*Primary Examiner* — Thanh Tam Le
(74) *Attorney, Agent, or Firm* — Altis & Wispro Law Group, Inc.

(57) ABSTRACT

A base is capable of containing a data cable, the data cable having a first plug, a second plug and a transmitting wire connecting the first plug and the second plug. The base includes a housing defining an opening; and a receiving member and a winding member positioned on the inner surface of the housing. The first plug is capable of protruding out of the housing via the opening, the transmitting wire is capable of being wound around the winding member, and the second plug is capable of being received in the receiving member.

18 Claims, 4 Drawing Sheets

BASE AND ELECTRONIC APPARATUS USING THE SAME

BACKGROUND

1. Technical Field

The present disclosure relates to bases, and particularly to a base for an electronic device and an electronic apparatus using the base.

2. Description of Related Art

Electronic devices, such as a mobile phone, a media player, or a personal digital assistant (PDA) generally include video playing and data transmitting functions. However, users need to hold such electronic devices to view the video. Furthermore, the electronic device may need a data cable detachably coupled to the electronic device to receive or transmit data from or to another electronic device. So, it is inconvenient for the users to use the electronic device.

Therefore, there is room for improvement within the art.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION

Figure 1:
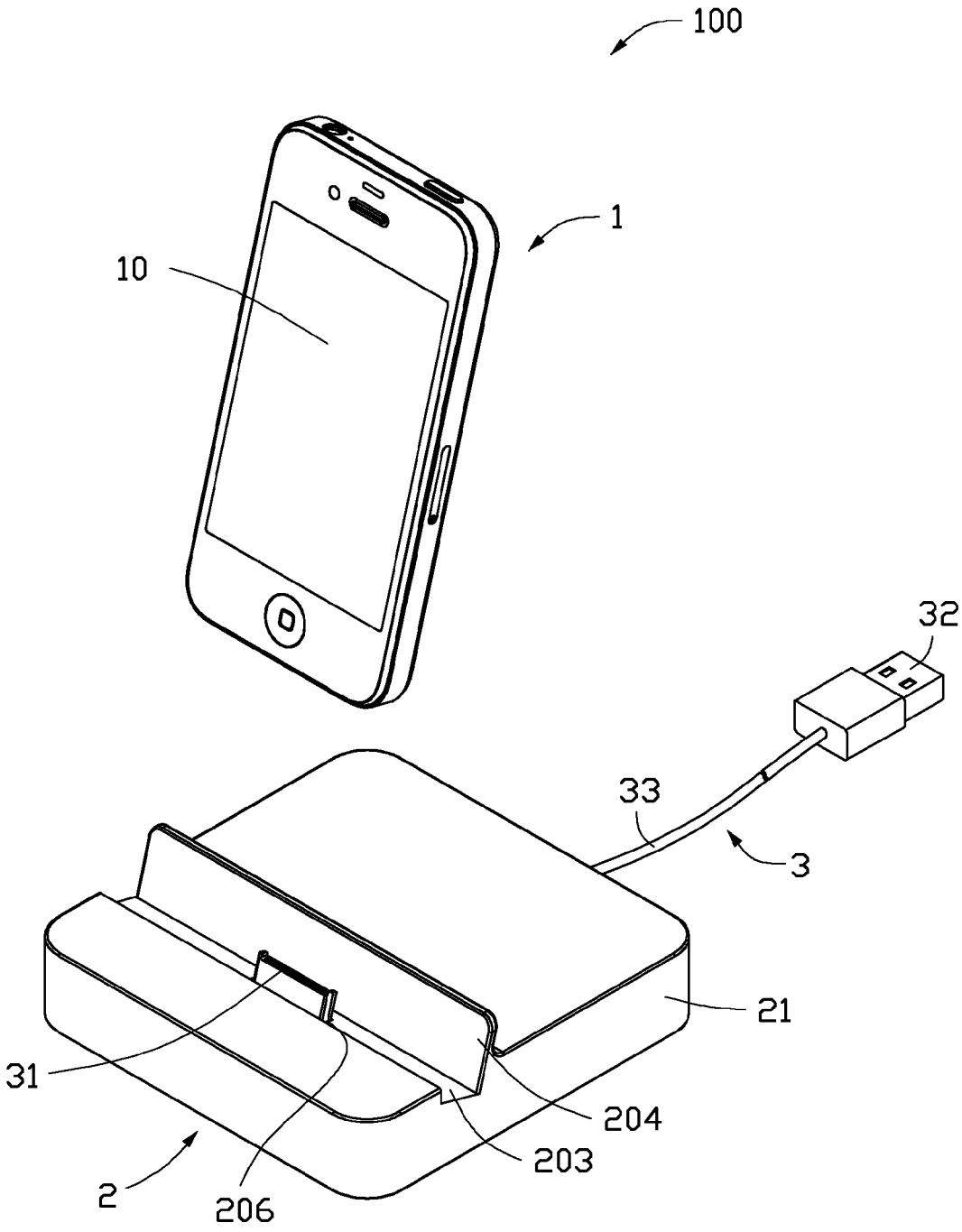
FIG. 1 is an isometric view of an electronic apparatus with a base.
Figure 2:
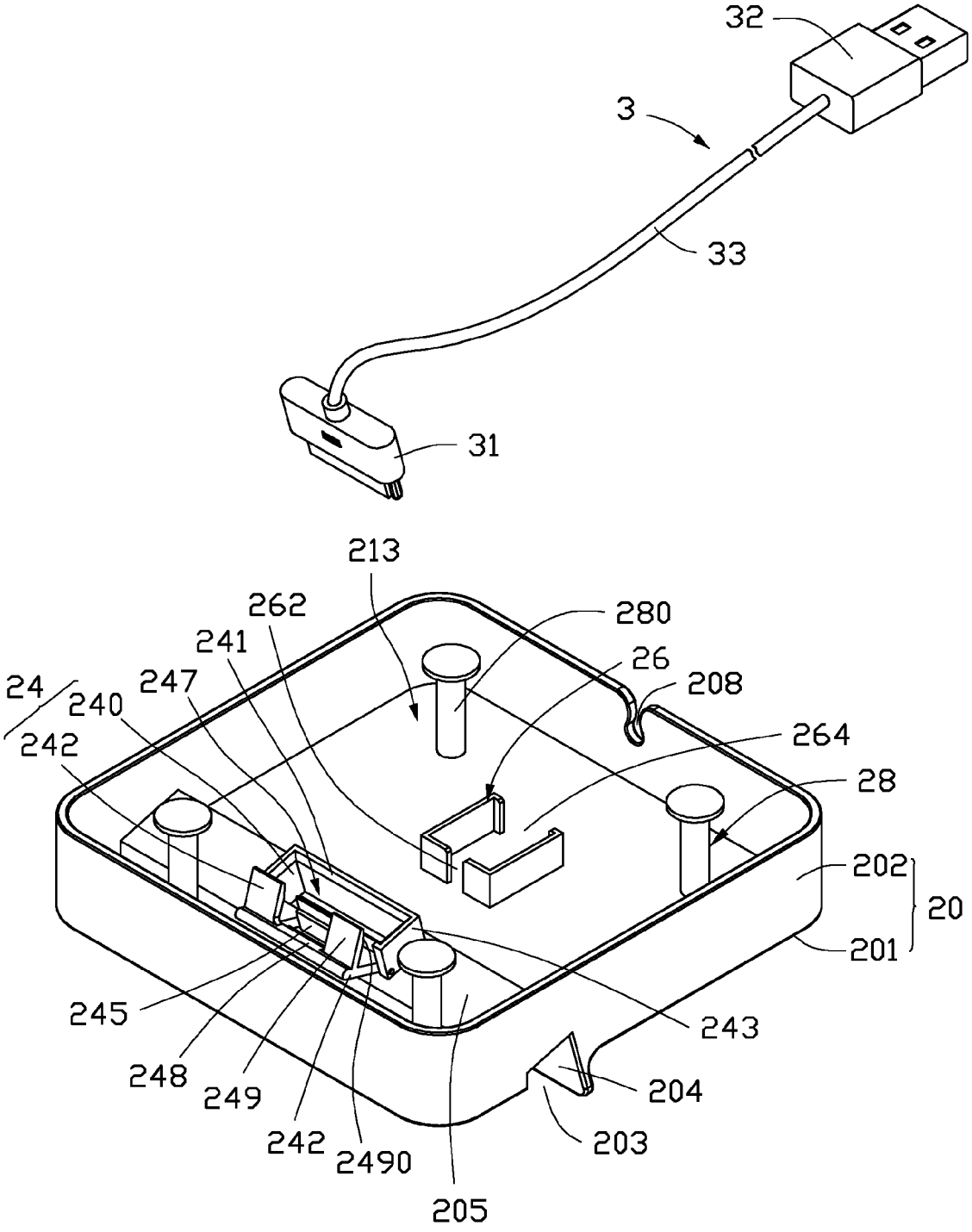
FIG. 2 is an exploded bottom view of the base in FIG. 1.
Figure 3:
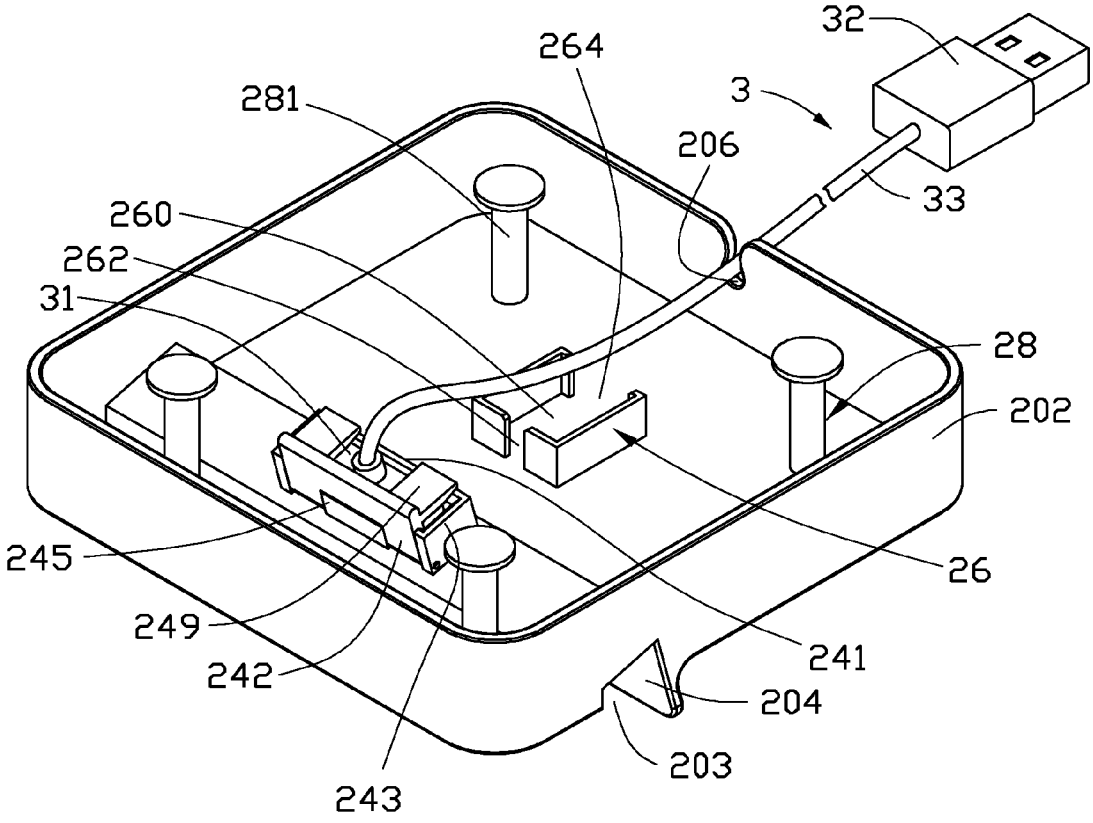
FIG. 3 is bottom view of the base in FIG. 1.
Figure 4:
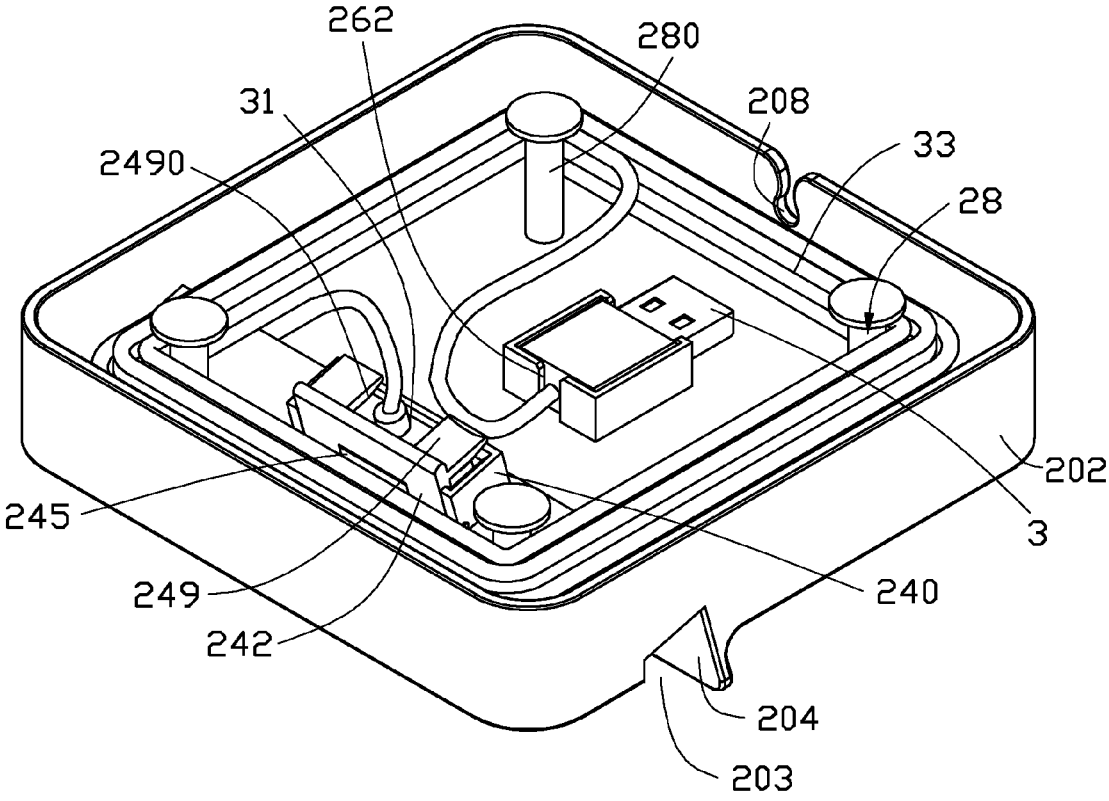
FIG. 4 is a bottom view showing the data cable wound.

Referring to FIGS. 1-4, an electronic apparatus 100 includes a base 2 capable of winding a data cable 3, for loading an electronic device 1. The electronic device 1 may be a mobile phone, a MP4 player, a PDA (personal digital assistant). The main body 10 of the electronic device 1 include a connector slot (not shown) disposed on the bottom wall of the main body 10. In another embodiment, the connector slot can also be disposed on a side or top wall of the main body 10.

The data cable 3 is for connecting the electronic device 1 to another electronic device (not shown), for the exchange of data between the electronic device 1 and the other electronic device. The data cable 3 includes a first plug 31, a second plug 32 and a transmitting wire 33 connected the first plug 31 and the second plug 32. The first plug 31 is capable of being coupled to the connector slot of the electronic device 1. The second plug 32 is capable of being coupled to the other electronic device. In the embodiment, the first plug 31 is different from the second plug 32. The first plug 31 is a 30 pin plug, and the second plug 32 is a USB plug. In another embodiment, the first plug 31 and the second plug 32 may be the same type of plug.

The base 2 includes a housing 20. The housing 20 includes a rectangular top wall 201, four sidewalls 202 perpendicularly extending from the boundary of the top wall 201, and a cavity space 213 defined by the top wall 201 and the sidewalls 202. One of the sidewalls 202 defines a first gap 208 and the first gap 208 is positioned on an end away from the top wall 201.

The external surface of the top wall 201 defines a long and narrow inserting recess 203 for receiving and electrically connecting the electronic device 1. The inserting recess 203 extends the width of the top wall 201. The top wall 201 presents a support board 204, protruding from the external surface of the top wall 201, for supporting the electronic device 1. The support board 204 protrudes out of the inserting recess 203, and includes an inclined surface (not labeled) facing the inserting recess 203. The inclined surface is inclined away from the inserting recess 203.

The inner surface of the top wall 201 presents a convex stage 205, a locking member 24, winding member 28, and a receiving member 26.

The convex stage 205 defines an opening 206. The opening 206 is in the central section of the convex stage 205 and communicates with the inserting recess 203. The opening 205 allows the pin part of the first plug 31 to protrude out of the top wall 201 to couple to the connector slot of the electronic device 1.

The locking member 24 includes a receiving part 240 and a locking part 242 pivoted to the receiving part 240. The receiving part 240 includes a first blocking wall 241, two second blocking wall 243, and a third blocking wall 245. The first blocking wall 241, the two second blocking walls 243 and the third blocking wall 245 are rectangular boards protruding from the convex stage 205 and are around the opening 206. And a first receiving space 247 is defined by the first blocking wall 241, the two second blocking walls 243 and the third blocking wall 245. The first blocking wall 241 is parallel with the third blocking wall 245. The two second blocking walls 243 are parallel with each other and respectively perpendicularly protrude from two opposite sides of first blocking wall 241 toward the third blocking wall 245. Third third blocking wall 245 is positioned between the two second blocking walls 243. Lengthwise, the distance between the two opposite edges of the first blocking wall 241 is longer than the distance between the two opposite edges of the third blocking wall 245.

The locking part 242 is a rectangular board with one end pivoted to the two second blocking wall 243. The locking part 242 defines a second gap 248 and sets two locking elements 249. The second gap 248 is positioned on the center of the edge of the locking part 242 and adjacent to the convex stage 205. The third blocking wall 245 is positioned in the second gap 248 and the second gap 248 is blocked by a part of the third blocking wall 245.

The two locking elements 249 protrudes from the locking part 242 to the receiving part 247 and away from the convex stage 205, for covering the first receiving space 247. Each of the two locking elements 249 includes a covex surface 2490 facing the first receiving space 247.

The receiving member 26 defines a second receiving space 260, a third gap 262 and a fourth gap 264. The second receiving space 260 is positioned in the center of the receiving member 26 for receiving the second plug 32. The third gap 262 and the fourth gap 264 are positioned on the sidewall around the second receiving space 260 and communicate with second receiving space 260. In this embodiment, the third gap 262 is defined on the one side of the receiving part 26 adjacent to the convex stage 205, and allows the transmitting wire 33 to pass through the receiving member 26. The fourth gap 264 is defined on one side of the receiving member 26 adjacent to the sidewall 202 where the first gap 220 is defined on, and allows a part of the second plug 234 to be clipped in the receiving member 214.

The winding member 28 includes a plurality of winding posts 280. In this embodiment, the winding member 28 includes four winding posts 280. The four winding posts 280 are positioned on four corners of the top wall 201, thus the four winding posts 280 surround the locking member 24 and the receiving member 26, and the four winding posts 280 allow the transmitting wire 33 to be wound around it. Further, the four winding posts 280 are higher than the sidewall 202 and capable of supporting the housing 20.

To assemble the data cable 3 to the base 2, the first plug 31 is passed through the second receiving space 247 and the opening 206 of the housing 20 so that the pin part (not labeled) of first plug 31, away from the transmitting wire 33 extends outside the housing 20. The locking part 242 is rotated to the receiving part 240, and first plug 31 is covered by the locking elements 249 to be secured in the housing 20. The transmitting wire 33 is wound around the four winding posts 280 beginning from the end connected to the first plug 31, and stopping at the second plug 33 is capable of extending to the receiving part 26. The end connected to the second plug 32 of the transmitting wire 33 is passed through the third gap 262, and the pin part (not labeled) of the second plug 32 away from the transmitting wire 33 is inserted into the fourth gap 264 to enable the second plug 32 to be secured in the housing 20. As the data cable 23 is received in the housing 20 in this way, the assembly of the base 2 is finished.

When the data cable 3 is connected to another electronic device, the second plug 32 is released from the receiving part 26, and the transmitting wire 33 is unwound. The transmitting wire 33 is passed through the first gap 208 to extend out of the housing 21, and at this point, the second plug 32 is capable of being coupled to the other electronic device.

When the data cable 3 is not being used, and the second plug 32 is detached from the other electronic device, the data cable 3 is wound again by the means described above.

As described above, in being supported by the base 2 instead of being held in the hand, the viewing of the electronic device 1 is easier and more convenient. Further, winding of the data cable 3 into the housing 20 of the base 2 avoids any carrying and storage difficulties concerning the data cable 3.

It is to be understood, however, that even though relevant information and the advantages of the present embodiments have been set forth in the foregoing description, together with details of the functions of the present embodiments, the disclosure is illustrative only; and changes may be made in detail, especially in the matters of shape, size, and arrangement of parts within the principles of the present embodiments to the full extent indicated by the broad general meaning of the terms in which the appended claims are expressed.

What is claimed is:

1. A base capable of containing a data cable, the data cable having a first plug, a second plug, and a transmitting wire connecting the first plug and the second plug; the base comprising:

a housing comprising a top wall and sidewalls protruding from the top wall, the top wall defining an opening;

a receiving member and a winding member both positioned on the inner surface of the top wall, and surrounded by the sidewalls;

wherein the receiving member is surrounded by the winding member, the first plug is capable of protruding out of the housing via the opening, the transmitting wire is capable of being wound around the winding member, the second plug is capable of being received in the receiving member.

2. The base of claim 1, wherein the winding member comprises a plurality of winding posts protruding from the housing.

3. The base of claim 2, wherein one sidewall of the housing defines a first gap to enable the transmitting wire to pass through the housing when it is unwound.

4. The base of claim 1, wherein the base further comprises a locking member, the locking member comprises a receiving part and a locking part pivoted to the receiving part, the receiving part is positioned on the inner surface of the top wall, one end of the first plug is capable of passing though the receiving part and the opening to protrude out of the top wall, the other end of the first plug is covered by the locking part.

5. The base of claim 4, wherein one end of the locking part is pivoted to the receiving part, the other end of the locking member protrudes two locking elements for covering the first plug and allows the transmitting wire to pass though the two locking elements therebetween.

6. The base of claim 1, wherein the receiving member defines a receiving space and a gap communicates with the receiving space, a part of the second plug is received in the receiving space, and the other part of the second plug is positioned in the gap and clipped by the receiving member.

7. A base for supporting an electronic device, and capable of containing a data cable to connect the electronic device to another electronic device, the data cable having a first plug, a second plug, and a transmitting wire connecting the first plug and the second plug, the base comprising:

a housing with a top wall defining an opening, and sidewall protruding from the top wall defining a first gap; and a winding member positioned on the inner surface of the top wall and surrounded by the sidewalls;

wherein the electronic device is positioned on the top wall, the first plug is capable of protruding out of the housing via the opening and electrically connected with the electronic device, the transmitting wire is capable of being wound the winding member, the second plug is capable of being positioned outside of housing, the transmitting wire is capable of passing through the housing via the first gap when it is unwound.

8. The base of claim 7, wherein the winding member comprises a plurality of winding posts protruding from the inner surface of the top wall, the transmitting wire is wound around the plurality of winding posts, and in contact with each of the plurality of winding posts.

9. The base of claim 8, wherein the base further comprises a receiving member, the receiving member is positioned on the inner surface of the top wall, the receiving member defines a receiving space and a second gap communicating with the receiving space, a part of the second plug is received in the receiving space, and the other part of the second plug is positioned in the second gap and clipped by the receiving member.

10. The base of claim 8, wherein the receiving member further comprises a third gap, the transmitting wire is passed through the third gap when the second plug is received in the receiving member.

11. The base of claim 8, further comprising a locking member, the locking member comprises a receiving part and a locking part pivoted to the receiving part, the receiving part is positioned on the inner surface of the top wall, one end of the first plug is capable of passing though the receiving part and the opening to protrude out of the top wall, the other end of the first plug is covered by the locking part.

12. The base of claim 11, wherein one end of the locking part is pivoted to the receiving part, the other end of the locking member protrudes a locking element for covering the first plug.

13. An electronic apparatus, comprising:

an electronic device;

a cable, the cable having a first plug, a second plug and a transmitting wire connecting the first plug and the second plug; and a base for receiving the data cable, the base comprising:

a housing defining an opening and a first gap; and a winding member received in the housing;

wherein the electronic device is positioned on the top wall, the first plug is capable of protruding out of the housing via the opening and electrically connected with the electronic device, the transmitting wire is capable of being wound around the winding member, the transmitting wire is capable of passing through the housing via the first gap, and the second plug is capable of being positioned outside of the housing when it is unwound.

14. The base of claim 12, wherein the winding member comprises a plurality of winding post protruding from the inner surface of the housing, and being opposite to the electronic device, the transmitting wire is wound around the plurality of winding posts, and in contact with each of the plurality of winding posts.

15. The electronic apparatus of claim 14, wherein the plurality of the winding posts are capable of supporting the housing.

16. The electronic apparatus of claim 14, further comprising a receiving member, the receiving member being positioned on the inner surface of the top wall, the receiving member defining a receiving space and a gap communicating with the receiving space, a part of the second plug being received in the receiving space, and the other part of the second plug being positioned in the second gap and clipped by the receiving member.

17. The base of claim 16, further comprising a locking member, the locking member comprising a receiving part and a locking part pivoted to the receiving part, the receiving part being positioned on the inner surface of housing and opposite to the electronic device, one end of the first plug being capable of passing though the receiving part and the opening to protrude out of the top wall, the other end of the first plug being covered by the locking part.

18. The base of claim 17, wherein one end of the locking part is pivoted to the receiving part, the other end of the locking member protrudes a locking element for covering the first plug.

* * * * *